US005746237A

United States Patent [19]

Arnic

[11] Patent Number: 5,746,237

[45] Date of Patent: May 5, 1998

[54] PORTABLE GARAGE

[76] Inventor: Garlon A. Arnic, 500 Ford La., Bartlett, Ill. 60103

[21] Appl. No.: 713,745

[22] Filed: Sep. 13, 1996

[51] Int. Cl.[6] ..... E04H 15/00

[52] U.S. Cl. ..... 135/88.06; 52/66; 52/64; 52/DIG. 14; 135/133; 135/134; 135/148

[58] Field of Search ..... 135/88.06, 88.13, 135/133, 134, 137, 147, 148, 151, 130, 132, 88.05, 88.08, 116; 52/63, 64, 66, DIG. 14

[56] References Cited

U.S. PATENT DOCUMENTS

| | | | |
|---|---|---|---|
| 2,798,501 | 7/1957 | Oliver | 135/134 |
| 4,425,929 | 1/1984 | Von Masshaim | 52/63 X |
| 4,432,581 | 2/1984 | Guma . | |
| 4,944,321 | 7/1990 | Moyet-Ortiz | 135/88.06 |
| 5,013,079 | 5/1991 | Ho . | |
| 5,044,132 | 9/1991 | Harman | 52/66 |
| 5,094,257 | 3/1992 | Wilson et al. . | |
| 5,141,966 | 8/1992 | Montoya | 135/88.06 X |

FOREIGN PATENT DOCUMENTS

| | | | |
|---|---|---|---|
| 1313259 | 11/1962 | France | 135/133 |

*Primary Examiner*—Wynn E. Wood
*Assistant Examiner*—Timothy B. Kang
*Attorney, Agent, or Firm*—Meroni & Meroni

[57] ABSTRACT

A portable, expandable protective vehicle cover comprising: a base, the base is sized to support a vehicle thereon and having a substantially flat upper surface; a canopy, the canopy is supported by a telescoping frame, the telescoping frame comprises a plurality of U-shaped ribs extending along outer edges of the base; and a drive structure, the drive structure is positioned along a horizontal central axis parallel to the flat upper surface within the base. A rotating rod is operatively connected to the drive structure, ends of the telescoping frame are pivotally connected to opposing edges on the rotating rod. The drive structure provides power to turn the rotating rod to extend the telescoping frame to open and closed positions thereby opening and closing the canopy and allowing a vehicle positioned on the base to be covered by the canopy.

19 Claims, 4 Drawing Sheets

PORTABLE GARAGE

BACKGROUND OF THE INVENTION

1. Field of the Invention

The present invention relates generally to vehicle covers. More specifically, the present invention relates to a portable vehicle cover that is easy to use and does not require a user to have to manually cover and uncover their vehicle by hand. The present invention allows for automatic covering of a vehicle, making it convenient and worthwhile for a vehicle owner to use.

2. Description of the Prior Art

Automobiles covers are typically used to protect the automobile from the elements of weather, such as the sun, rain, snow, wind, dirt, leaves, etc. Automobile covers do not require an abundant amount of space, such as a garage, therefore automobile covers can be very useful when one does not have the required garage space and wishes to protect their automobile from the elements. These automobile covers, however, typically need to be manually installed on a vehicle and can be quite cumbersome for one to install and remove. Furthermore, since the covers can be quite large, managing such car covers can be difficult and are not easily foldable.

Various different types of automobile covers have been proposed, however, none of these car covers offer the ease of use and flexibility of the present invention. Such previous automobile covers include covers that are directly attached to the sides of bumpers of a vehicle, therefore requiring one to install such a car cover on their vehicle and modifying the structure of their vehicle to accommodate such an automobile cover.

These and other types of automobile covers disclosed in the prior art do not offer the flexibility and inventive features of my portable garage. As will be described in greater detail hereinafter, the automobile cover of the present invention differs from those previously proposed.

It is therefore an object of the present invention to provide a car cover that is easy to use and does not require one to spend time to unfold and install on a vehicle as well as remove and fold up the cover.

It is a further object of the present invention to provide an automobile cover that does not require one to install on their vehicle and therefore not requiring such a user to modify their vehicle.

It is yet a further object of the present invention to provide a vehicle cover that provides protection from the elements similar to a garage and is portable as well as compact.

SUMMARY OF THE INVENTION

According to my present invention I have provided a portable, expandable protective vehicle cover comprising: a base, the base being sized to support a vehicle thereon and having a substantially flat upper surface; a canopy, the canopy being supported by a telescoping frame, the telescoping frame comprising a plurality of U-shaped ribs extending along outer edges of the base; and a drive structure, the drive structure being positioned along a horizontal central axis parallel to the flat upper surface within the base, a rotating rod operatively connected to the drive structure, ends of the telescoping frame being pivotally connected to opposing edges on the rotating rod, the drive structure providing power to turn the rotating rod to extend the telescoping frame to open and closed positions thereby opening and closing the canopy and allowing a vehicle positioned on the base to be covered by the canopy.

Another feature of my invention relates to the portable, expandable protective vehicle cover described above, wherein the drive structure comprises: a vehicle engaging arm, the vehicle engaging arm extends upwardly beyond the flat upper surface at a height sufficient to engage a bumper of a vehicle, the vehicle engaging arm being movable laterally across a vertical central axis parallel to the flat upper surface, the vehicle engaging arm being spring loaded, a chain drive connected to the vehicle engaging arm, the chain drive being operatively connected with said rotating rod, the vehicle engaging arm being movable backwards when engaged by a moving vehicle causing the chain drive to turn the rotating rod to extend the telescoping frame to a fully extended position, the vehicle when moved away from the vehicle engaging arm causing the telescoping frame to retract due to the spring loaded forces counter rotating the vehicle engaging arm.

Still another feature of my invention concerns the portable, expandable protective vehicle cover described earlier, wherein the drive structure is powered by an electrical motor.

A further feature of my invention concern the protective cover described earlier, wherein the drive structure is a drive mechanism selected from the group consisting of: a chain drive, a screw drive, and a belt drive.

According to important features of my invention I have also provided a portable, expandable protective vehicle cover as described above, wherein the U-shaped ribs and the canopy open and close in an accordion type fashion and further includes an access opening along a side area on the canopy to allow a person to exit and enter the canopy when the canopy is in a fully extended position.

Yet another feature of my invention I have provided a portable, expandable protective vehicle cover as described above, wherein the canopy is a flexible, lightweight, weather resistant material selected from the group consisting of: canvas, plastic, transparent plastic, nylon, vinyl, rubber and fabric.

According to still further features of my invention I have also provided a portable, expandable protective vehicle cover as described above, wherein said vehicle cover further includes a locking structure, the locking structure allowing a user to lock the canopy when the canopy is in a fully extended position.

Still even further features of my invention concern the portable, expandable protective vehicle canopy described above, wherein the vehicle canopy is sized to accommodate a vehicle selected from the group consisting of: automobiles, motorcycles, pick-up trucks, mini-vans, vans, trucks, and bicycles.

Other objects, features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
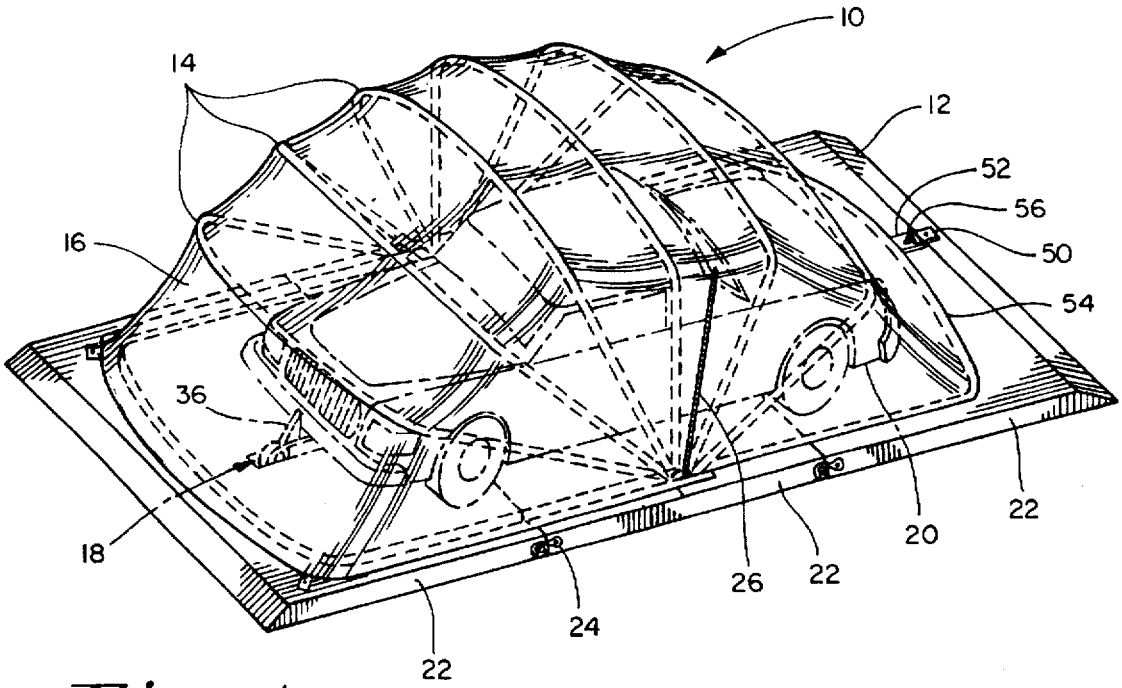
FIG. 1 is a perspective view of my portable garage vehicle cover expanded over an automobile.
Figure 2:
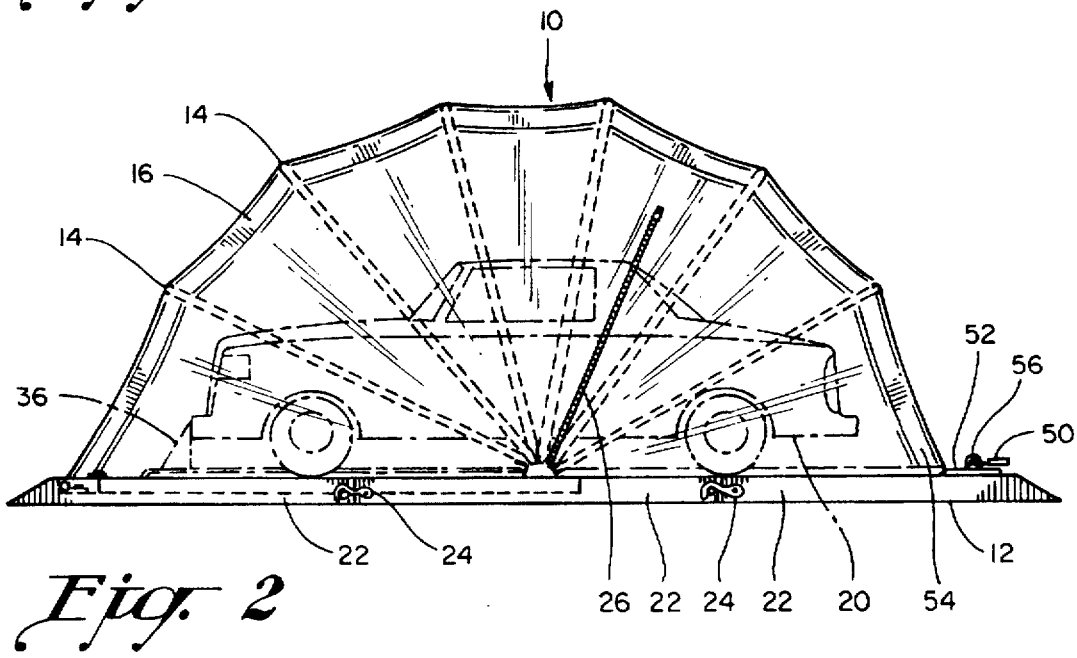
FIG. 2 is a side view of my vehicle cover expanded over an automobile embodying important features of my invention.

Referring now to the drawings, FIGS. 1 and 2 show my new and improved automobile cover or portable garage 10. The cover 10 comprises a base 12, a telescoping frame structure 14, a canopy 16, and a drive mechanism 18. The base 12 has a flat surface and is sized to support a vehicle 20 thereon. The base can be constructed of a variety of materials including durable plastic, wood, and metal. It is preferred that the base be made lightweight in order to make the portable garage 10 portable and easily movable. It is desired that the base would be water resistant as well as providing necessary water drainage in the event of rain collecting onto the portable garage.

In order to make the portable garage easy to move, the base 12 can be split into a plurality of sections 22. The sections can be hooked together with hooks 24 to provide a uniform base. The base can also be hinged at edges of each of the sections to enable the base to fold the base and allow a user to easily move the portable garage to an appropriate location. FIGS. 1 and 2 illustrate a base 12 that is split into three portable sections 22.

The canopy 16 is supported by the telescoping frame structure 14, wherein on end of the frame structure is secured with a fastener 23 (FIG. 3) to the base. The canopy can be made from a variety of materials such as canvas, plastic, transparent plastic, nylon, vinyl, rubber, or plastic. The telescoping frame is made of a plurality of U-shaped ribs that extend along the outer edges of the base. When the canopy is in a fully extended position, an access opening 26 is provided to allow a user to exit and enter the portable garage. The access opening 26 is created by making a slit in the side of the canopy. The slit can be opened and closed by a fastening structure such as a zipper, hook and loop fasteners, snaps, hooks, buttons, or any other suitable fastening structure.

Figure 3:
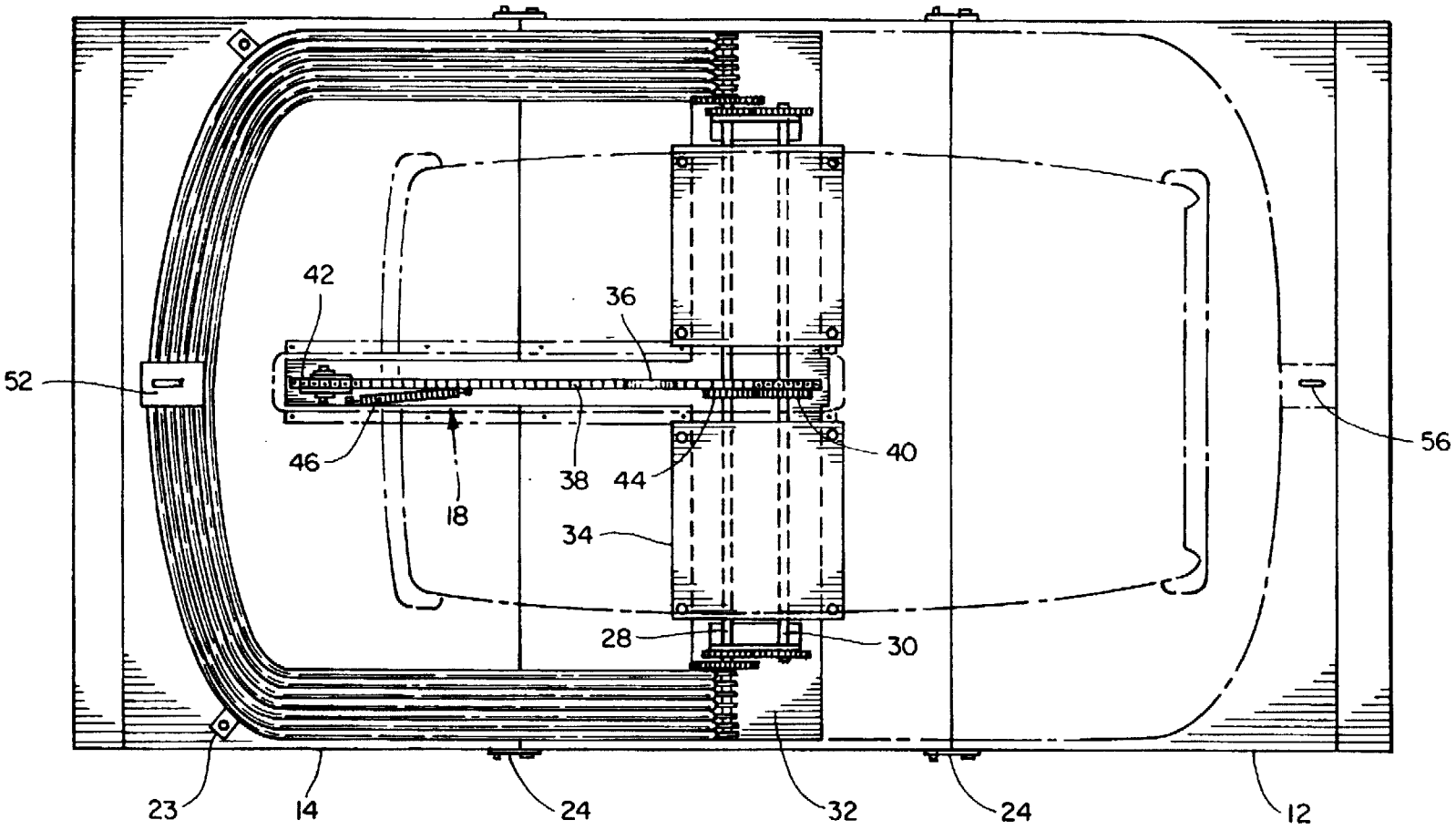
FIG. 3 is a cut-away top plan view of a drive mechanism used to power my expandable vehicle cover.
Figure 4:
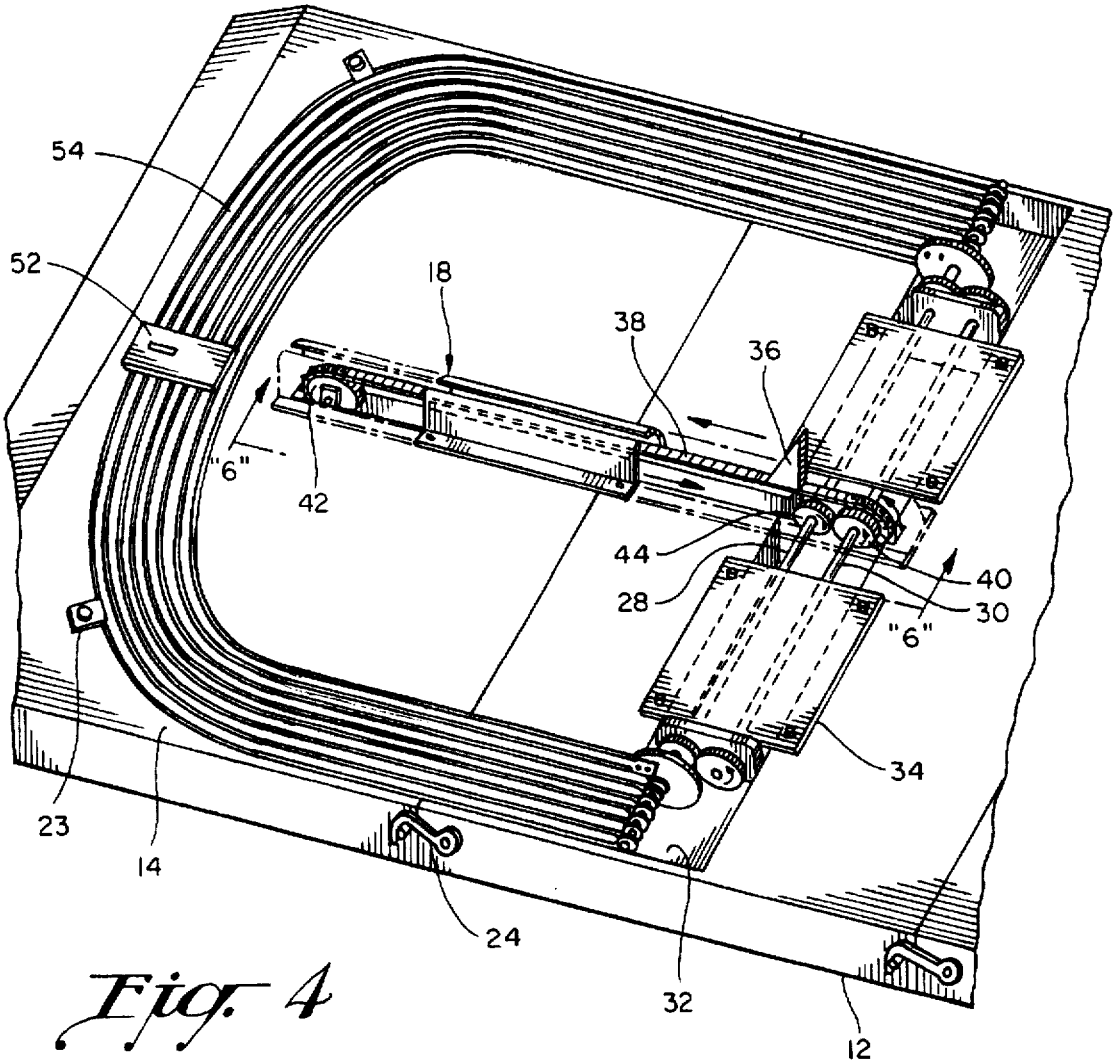
FIG. 4 is a perspective view partially cut-away of a drive mechanism used to power my portable garage vehicle cover.
Figure 6:
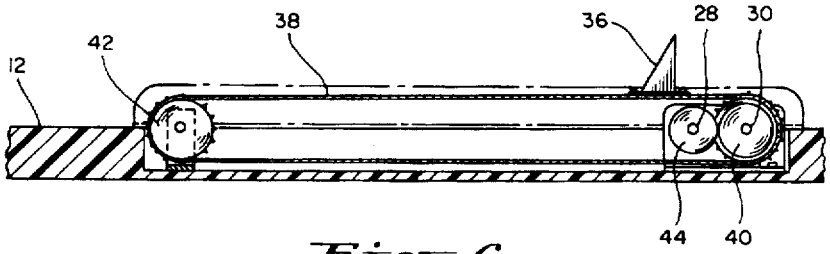
FIG. 6 is a partial side view of the base of my portable garage taken along the lines 6—6 in FIG. 3 embodying further important features of my invention.

The drive mechanism 18 is positioned within the base 12 and is located along a horizontal central axis parallel to the flat surface of the base (FIGS. 3, 4 and 6). A pair of rotating rods 28, 30 are operatively connected to the drive mechanism. The ends of the U-shaped frame are pivotally connected to opposing edges on one of the rotating rods 28. When the drive mechanism is powered, the rotating rods are turned thereby extending the telescoping frame structure along with the canopy to open and closed positions thereby allowing a vehicle positioned on the base to be securely covered by the canopy.

The drive mechanism can be powered through various different means including electricity. Utilizing electrical power, an electrical motor can be attached to the drive mechanism to open and close the canopy on the portable garage. Various different drive mechanisms can be used to open and close the canopy, such drive mechanisms include a chain drive, a belt drive, and a screw drive.

The drive mechanism can also be powered without electricity with the use of the force of a vehicle entering onto the base of the portable garage. FIGS. 3 and 4 further illustrate the use of force from an entering vehicle. The drive mechanism is installed within a recess 32 in the base 12. The drive mechanism is covered with cover plates 34 over a portion of the recess 32 to allow a vehicle to drive over the drive mechanism and onto the base. To utilize the force of the entering vehicle, a vehicle engaging arm 36 is positioned on the drive mechanism along the base 12 of the portable garage. The engaging arm 36 extends upwardly from beyond the flat surface of the base at a height sufficient to engage a bumper or wheel of a vehicle. The engaging arm 36 is connected to a chain drive 38. The chain drive 38 rotates around a first gear 40 that is attached to the first rotating rod 30. The chain drive 38 rotates about a second pivot point 42 to allow the engaging arm to move back and forth along the drive mechanism.

As the vehicle is driven onto the base 12, the engaging arm 36 is moved backwards laterally across a vertical central axis parallel to the flat surface of the base 12. As the first gear 40 is turned due to the force of the vehicle on the engaging arm, the second rotating rod 28 is rotated in an opposite direction by a second gear 44 that is direct contact with the first gear 40. The rotation of the of the second rotating rod 28 opens the canopy structure by moving the frame structure to a fully extended position. The engaging arm 36 is spring loaded with a spring 46 to enable the engaging arm 36 to move back to its original position when the vehicle is removed. Therefore, the lateral movement of the engaging arm 36 causes the chain drive 38 to turn the rotating rods 28, 30 thereby extending the telescoping frame structure 14 to a fully extended position.

As the vehicle is moved away from the engaging arm the telescoping frame structure 14 and canopy 16 retract due to the spring loaded forces counter rotating the vehicle engaging arm 36. A chain drive will provide excellent results, however, other drive mechanisms can also be used, such as a belt drive and a screw drive. Excellent results can be obtained when the telescoping frame structure and the canopy are designed to extend and retract in an accordion type fashion. The frame structure is can be designed such that each U-shape frame member 14 will retract in an orderly fashion. One such example is illustrated in FIGS. 3 and 4, wherein the first frame member is designed to be the largest frame member and is positioned along the outer edges of the base. The second frame member is slightly smaller than the first frame member and is adjacent to the inside of the first frame member. Each of the following frame members continue to slightly decrease in size so that they lie adjacent to each other when the portable garage is in a fully retracted position.

Figure 5:
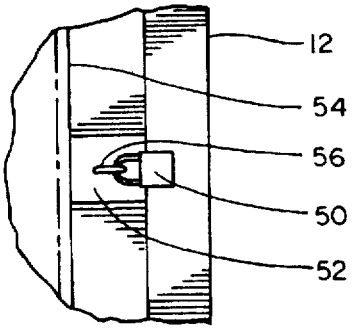
FIG. 5 is a partial top plan view illustrating a locking device used to lock my portable garage.

Once the portable garage is in a fully extended position, the canopy and/or frame structure can be locked to the base 12 to prohibit anyone from removing the vehicle from the portable garage. FIGS. 1, 2, and 5 illustrate the use of a padlock 50 to lock the portable garage when in a fully extended position. A slotted plate 52 is attached to the last extended U-shaped frame 54 and telescopically engages a locking loop 56. A padlock 50 can then be locked onto locking loop 56 and thereby locking the portable garage in a fully extended position. Other security means, such as other type of locks, cables, or alarms can also be used to protect access to the portable garage as well as the portable garage itself.

The slotted plate 52 can also be used to help retract the frame structure 14 in an orderly fashion to a fully retracted position. The slotted plate 52 is designed to extend a predetermined distance beyond the end of the last U-shaped frame member so that it can make contact with the remaining frame members when the canopy is being retracted. Since the last U-shaped frame member is the smallest frame, the added length of the slotted plate 52 allows the slotted plate on the last frame member to make contact to the remaining frame members and help retract the frame members when the canopy is being retracted.

Figure 7:
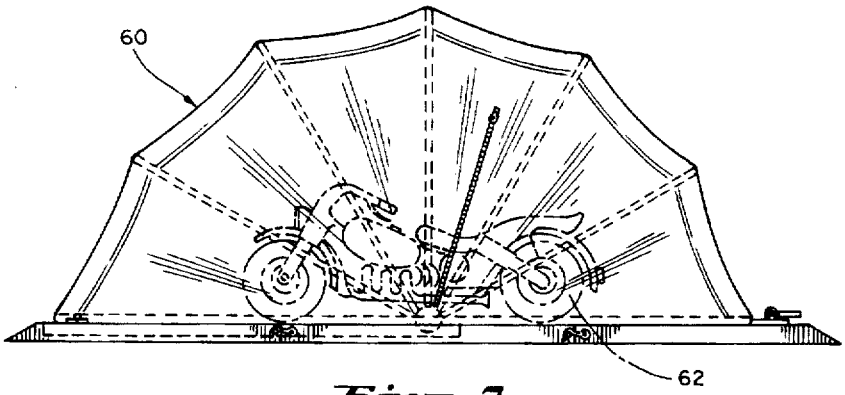
FIG. 7 is a side view of yet another embodiment of my vehicle cover in a fully expanded position over a motorcycle.

The portable garage is not limited as to the type of vehicle that it can house. Referring to FIG. 7, the portable garage 60 can be made to also accommodate other vehicles such as a motorcycle 62. The portable garage can also be sized to accommodate pick-up trucks, mini-vans, vans, trucks, and even bicycles.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A portable, expandable protective vehicle cover comprising:

a base, said base being sized to support a vehicle thereon and having a substantially flat upper surface; a canopy, said canopy being supported by a telescoping frame, said telescoping frame comprising a plurality of U-shaped ribs extending along outer edges of said base; and a drive means, said drive means comprising: a vehicle engaging arm, said vehicle engaging arm extending upwardly from the base at a height sufficient to engage a bumper of a vehicle, said drive means being positioned along a horizontal central axis parallel to the flat upper surface within said base, a rotating rod operatively connected to said drive means, ends of said telescoping frame being pivotally connected to opposing edges on said rotating rod, said plurality of U-shaped ribs designed to retract in an orderly sequence such that a first U-shaped rib member is designed to be larger than remaining U-shaped ribs, and each consecutive U-shaped rib member is slightly smaller than a previous U-shaped rib member so that the plurality of U-shaped ribs lie adjacent to each other in a relatively flat position, said drive means providing power to turn said rotating rod to extend and retract said telescoping frame to open and closed positions thereby opening and closing said canopy and allowing a vehicle positioned on the base to be covered by the canopy.

2. A portable, expandable protective vehicle cover according to claim 1, wherein said drive means comprises: a vehicle engaging arm, said vehicle engaging arm extending upwardly beyond said flat upper surface at a height sufficient to engage a bumper of a vehicle, said vehicle engaging arm being movable laterally across a vertical central axis parallel to the flat upper surface, said vehicle engaging arm being spring loaded, a chain drive connected to said vehicle engaging arm, said chain drive being operatively connected with said rotating rod, said vehicle engaging arm being movable backwards when engaged by a moving vehicle causing said chain drive to turn said rotating rod to extend said telescoping frame to a fully extended position, said vehicle when moved away from said vehicle engaging arm causing said telescoping frame to retract due to the spring loaded forces counter rotating the vehicle engaging arm.

3. A portable, expandable protective vehicle cover according to claim 2, wherein said canopy is a flexible, lightweight, weather resistant material selected from the group consisting of: canvas, plastic, transparent plastic, nylon, vinyl, rubber and fabric.

4. A portable, expandable protective vehicle cover according to claim 2, wherein said vehicle cover further includes a locking means, said locking means allowing a user to lock said canopy when the canopy is in a fully extended position.

5. A portable, expandable protective vehicle cover according to claim 1, wherein said drive means is powered by an electrical motor.

6. A portable, expandable protective vehicle cover according to claim 1, wherein said drive means is a drive mechanism selected from the group consisting of: a chain drive, a screw drive, and a belt drive.

7. A portable, expandable protective vehicle cover according to claim 1, wherein said U-shaped ribs and said canopy open and close in an accordion type fashion.

8. A portable, expandable protective vehicle cover according to claim 1, wherein said canopy further includes an access opening along a side area on the canopy to allow a person to exit and enter said canopy when the canopy is in a fully extended position.

9. A portable, expandable protective vehicle cover according to claim 1, wherein said canopy is a flexible, lightweight, weather resistant material selected from the group consisting of: canvas, plastic, transparent plastic, nylon, vinyl, rubber and fabric.

10. A portable, expandable protective vehicle cover according to claim 1, wherein said vehicle cover further includes a locking means, said locking means allowing a user to lock said canopy when the canopy is in a fully extended position.

11. A portable, expandable protective vehicle canopy according to claim 1, wherein said vehicle canopy is sized to accommodate a vehicle selected from the group consisting of: automobiles, motorcycles, pick-up trucks, mini-vans, vans, trucks, and bicycles.

12. In combination with a vehicle, a portable, expandable protective vehicle cover comprising:

a base, said base being sized to support a vehicle thereon and having a substantially flat upper surface; a canopy, said canopy being supported by a telescoping frame, said telescoping frame comprising a plurality of U-shaped ribs extending along outer edges of said base; and a drive means, said drive means being positioned along a horizontal central axis parallel to the flat upper surface within said base, a rotating rod operatively connected to said drive means, said drive means comprising: a vehicle engaging arm, said vehicle engaging arm extending upwardly beyond said flat upper surface at a height sufficient to engage a bumper of a vehicle, said vehicle engaging arm being movable laterally across a vertical central axis parallel to the flat upper surface said vehicle engaging arm being spring loaded, a chain drive connected to said vehicle engaging arm, said chain drive being operatively connected with said rotating rod, said vehicle engaging arm being movable backwards when engaged by a moving vehicle causing said chain drive to turn said rotating rod to extend said telescoping frame to a fully extended position, said vehicle when moved away from said vehicle engaging arm causing said telescoping frame to retract due to the spring loaded forces counter rotating the vehicle engaging arm, ends of said telescoping frame being pivotally connected to opposing edges on said rotating rod, said drive means providing power to turn said rotating rod to extend and retract said telescoping frame to open and closed positions thereby opening and closing said canopy and allowing a vehicle positioned on the base to be covered by the canopy.

13. The combination of claim 12, wherein said drive means is powered by an electrical motor.

14. The combination of claim 12, wherein said U-shaped ribs and said canopy open and close in an accordion type fashion.

15. The combination of claim 12, wherein said canopy further includes an access opening along a side area on the canopy to allow a person to exit and enter said canopy when the canopy is in a fully extended position.

16. The combination of claim 12, wherein said canopy is a flexible, lightweight, weather resistant material selected from the group consisting of: canvas, plastic, transparent plastic, nylon, vinyl, rubber and fabric.

17. The combination of claim 12 wherein said vehicle cover further includes a locking means, said locking means allowing a user to lock said canopy when the canopy is in a fully extended position.

18. A portable, expandable protective cover assembly for a vehicle comprising:

a base sized to accommodate said vehicle thereon;

cover means attached to said base; and drive means for extending and retracting said cover means, said cover means for covering said vehicle when said cover means is in a fully extended position, said cover means for uncovering said vehicle when said cover means is in a fully retracted position, said drive means comprising: a vehicle engaging arm, said vehicle engaging arm extending upwardly from the base at a height sufficient to engage a bumper of a vehicle, said vehicle engaging arm being movable laterally across a vertical central axis parallel to the base, said vehicle engaging arm being movable backwards when engaged by a moving vehicle causing a drive mechanism to activate said cover means and to cover the vehicle, said vehicle engaging arm being movable forwards when disengaged by a moving vehicle cause said drive mechanism to activate said cover means and to uncover the vehicle.

19. A portable, expandable protective cover according to claim 18, wherein said cover means comprises: a canopy, said canopy being supported by a telescoping frame, said telescoping frame comprising a plurality of U-shaped ribs extending along outer edges of said base.

* * * * *